United States Patent [19]

Gorman

[11] 4,136,688

[45] Jan. 30, 1979

[54] PROTECTIVE DEVICES

[75] Inventor: Anthony G. Gorman, Ruislip, England

[73] Assignee: Racal-Amplivox Communications Ltd., Wembley, England

[21] Appl. No.: 775,634

[22] Filed: Mar. 8, 1977

[30] Foreign Application Priority Data

Mar. 31, 1976 [GB] United Kingdom ..... 13027/76

[51] Int. Cl.[2] ..... A61F 9/06

[52] U.S. Cl. ..... 128/142.7; 128/145 R; 2/10; 2/424; 2/171.3

[58] Field of Search ..... 128/145 R, 142.7, 142.5, 128/142.6, 140 N, 139, 357, 141 R; 132/1 R; 2/171.3, 411, 413, 181, 423, 417, 424, 435, 436, 437, 9, 10; 15/159 A

[56] References Cited

U.S. PATENT DOCUMENTS

| | | | |
|---|---|---|---|
| 2,432,264 | 12/1947 | Tyler | 15/159 A |
| 2,528,303 | 10/1950 | Gillespie | 128/140 N |
| 3,424,152 | 1/1969 | Kuhlman | 128/139 |
| 3,822,698 | 7/1974 | Guy | 128/142.7 |
| 3,963,021 | 6/1976 | Bancroft | 128/142.7 |

*Primary Examiner*—Henry J. Recla
*Attorney, Agent, or Firm*—Lawrence E. Laubscher

[57] ABSTRACT

A respirator is sealed at its sides to the face of a wearer by seals or air flow restricting members comprising a multiplicity of bristles. The length of the bristles is chosen so that they are deflected to lie at their free ends against the wearer's face. The length resilience and packing density of the bristles is selected to provide a required resistance to air flow. The bristles are of horse hair, camel hair, nylon, polypropylene or other noninjurious material. Preferred bristle diameters are 0.03 to 0.25 mm and lengths 10 to 30 mm.

9 Claims, 6 Drawing Figures

PROTECTIVE DEVICES

CROSS-REFERENCES TO RELATED APPLICATIONS

Co-pending patent application Ser. No. 771,769 for PROTECTIVE VISOR MEANS FOR A HELMET filed on Feb. 24, 1977, now U.S. Pat. No. 4,097,929, in the names of Brian Lowe and Raymond Odell. Co-pending patent application Ser. No. 771,781 for IMPROVED ANTI-DUST HELMET filed on Feb. 24, 1977 in the names of Brian A. Lowe and Raymond Odell.

BACKGROUND OF THE INVENTION

1. Field of the Invention

In some hazardous environments it is desirable or essential to protect personnel from the environmental hazards by supplying breathing air which has been filtered or purified to a sufficient extent to provide adequate respiratory protection.

One class of such device for providing this respiratory protection is based on head-wear such as a helmet or soft cap. The interior space between the head and the helmet shell or cap is arranged to be supplied with sufficiently pure air either by a built-in air filter and fan or by a remote pure air supply fed to the helmet interior by a suitable tube or pipe. The flow of filtered or purified air after going through the above-mentioned interior space, must be contained around the wearer's nose and mouth and this can be achieved by a suitable design of transparent full-face visor, advantageously that described in the above-identified application of Lowe and Odell.

In order to contain the purified airflow appropriately, the rear edges of the visor must be sufficiently sealed to the sides of the wearer's face to prevent unwanted escape of air. Once this sealing has been suitably effected the purified air, after passing over the wearer's nose and mouth, then escapes to atmosphere either via an unsealed gap at the lower edge of the visor or through a one-way exhaust valve if the visor-to-face sealing has been continued around the lower edge of the visor.

2. Description of the Prior Art

It is known for respiratory protective devices to be sealed against a wearer's face by sealing means comprising resilient strips of solid or foamed rubber or other elastomeric material. Such arrangements have required the sealing strip to be applied with substantial force against the wearer's face to form an effective seal and it has been found that varying forms of sealing member are necessary to accommodate a respirator to the widely differing head shapes for which it may be required.

SUMMARY OF THE INVENTION

The present invention relates to an improved face seal for a respirator.

It is an object of the invention to provide a respirator face seal which is highly adaptable to different head shapes of wearers, so that a larger range of head sizes and shapes be accommodated and with effective air seal, than with previously known sealing arrangements.

It is a further object of the invention to provide a respirator face seal which is less oppressive for the wearer of a respirator than are many known face seals.

It is a particular object of the invention to provide a very efficient seal that resists unwanted escape of air by automatically and effectively adapting to even the most minor variations in shape and size of the wearer's face.

It is also an object of the invention to provide a respirator face seal by which perspiration is removed from the wearer's face at the point of contact of the seal with the face.

The sealing means of the invention consists of a multiplicity of bristles of suitable material, diameter, length and stiffness which are arranged to project from a backing strip to which the bristles are firmly attached and which is itself secured to the margin of a respirator visor. A suitable number of rows of bristles is used so as to provide an adequate width of contact between the free ends of the bristles and the wearer's face. The lengths of the rows of bristles are arranged according to the design of the visor, so as to provide the required sealing action from the uppermost necessary point to the lowermost necessary point on the side of the face.

The backing strip of the bristles can be attached to the edge of the visor in any one of a number of ways. If a single size of visor is intended to cover the whole range of human head and face sizes, then it may be advantageous to insert another adaptor member between the edge of the visor and the backing strip of the bristles so as to take up some of the large gap which may exist between the visor edge and wearer's face when the face is of small or very small size. This member can be produced by moulding or any other appropriate process and may take the form of a nominally flat strip. One edge of said strip would be designed to suitably attach to the edge of the visor and the other edge of said strip would be designed to accommodate the backing strip of the bristles. If necessary this additional member can be made in a variety of sizes. An important associated advantage is that the degree of comfort is high and a further advantage is that any perspiration produced by the wearer at the area of contact between the bristles and the skin tends to travel along the lengths of the bristles by capillary action whence it is effectively evaporated by the aforesaid airflow within the visor.

In use, the bristles and their backing strip are so attached to the edges of a respirator visor that the free ends of the bristles bear against the wearer's face and the lengths of the bristles are so selected that there is more length of bristle than is required to span the gap between the edges of the visor and the surface of the wearer's skin. In these circumstances the bristles easily deflect to accommodate variations in the aforementioned gap thus effectively taking up variations in the gap, according to the sizes and shapes of the faces and thereby providing the required air seal. The density of the multiple rows of bristles can easily be arranged to provide a sufficiently effective air seal.

By adjustment of the diameter and other parameters of the bristles the required air seal and fit to the contours of the face can be effected without discomfort. In this respect it may be advantageous to angle the longitudinal axes of the individual bristles so that they do not tend to touch the face perpendicularly. This modification within the scope of the invention can further increase comfort.

Any angle at which the bristles are designed to touch the face can be in any plane according to particular circumstances and requirements and this angle will in any case vary at various points on the face.

The bristles can be of any required diameter and length and in any suitable natural or synthetic material. Use can also be made of the known art, to produce any reasonable required profile at those ends of the individual bristles which touch the wearer's face.

DESCRIPTION OF THE PREFERRED EMBODIMENT

Figure 1:
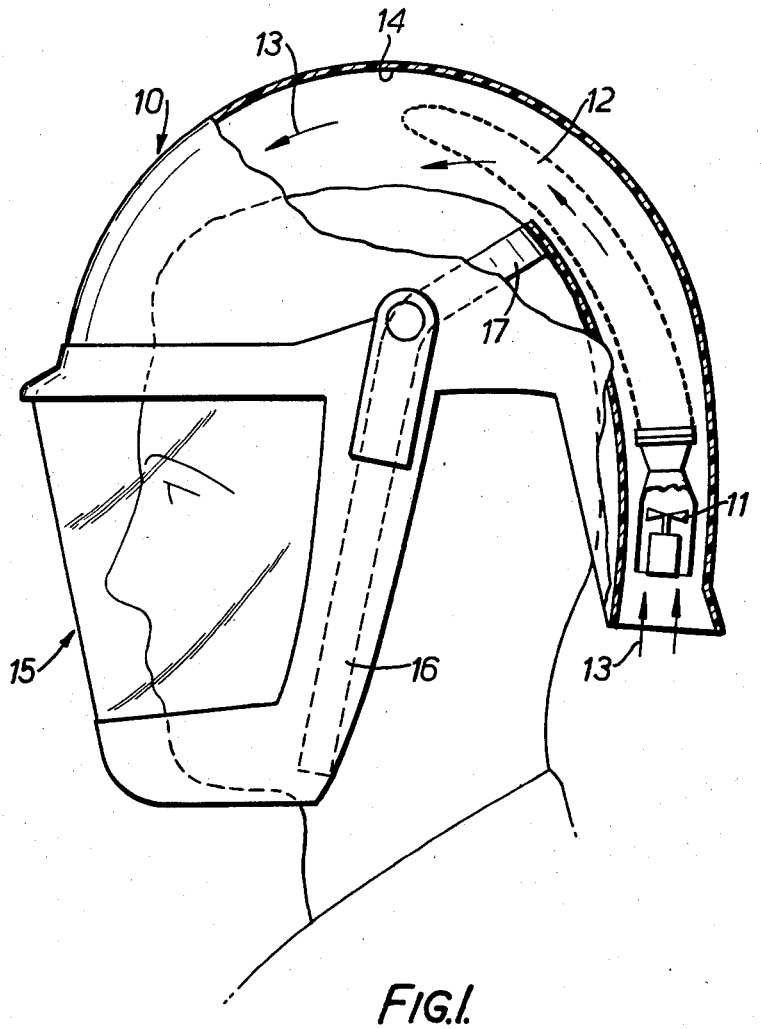
FIG. 1 shows a partly cut-away side view of one form of respiratory helmet incorporating the invention, applied to a human head.

Referring to the partly cut-away side view of the complete respiratory helmet assembly shown in FIG. 1, within the helmet 10 is schematically shown an air moving motor driven fan assembly 11 which passes air through a filter 12, which filter can be of any form and not necessarily a filter bag as shown herein. The direction of airflow is shown by the arrows 13 as entering the assembly at the back below the fan assembly and then passing through the filter 12 into the space 14 between the wearer's head and the outer shell of the helmet and finally passing down over the face past the nose and mouth and eventually exhausting to atmosphere at the bottom of a visor 15. The position of one of the visor/-face sealing members of the invention is indicated at 16 the rear edge of the visor 15.

17 indicates a device for sealing the helmet to the wearer's head to prevent unwanted escape of air from the space between the helmet and the head, so forcing the purified airflow to pass between the visor and the face without air loss. This air sealing member is described in the co-pending Lowe et al application Ser. No. 771,781 above referred to.

Figure 2:
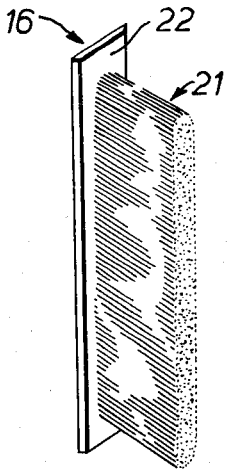
FIG. 2 shows a sealing member in accordance with the invention, comprising bristles attached to a backing or mounting strip.

Referring to FIG. 2, there is shown a seal 16 as used in FIG. 1, comprising a plurality of rows of bristles 21 attached to a backing strip 22 arranged to be secured to the rear edge of visor 15.

A number of natural or synthetic fibres may be used for the bristles, such as horse hair, camel hair, nylon, polypropylene, etc. A likely range of bristle diameters is 0.03mm–0.15 mm. A preferred range of bristle lengths is 10mm–30mm. The number of rows of bristles is usually between 1 and 4. The choice of bristle length and bristle diameter within the ranges quoted depends on the bristle material and also on the angle at which the bristles are intended to contact the wearer's face. If the bristles in any particular exemplification of the invention are designed to approach the wearer's face at an acute angle, then the bristles may be relatively stiff. If on the other hand, the bristles are designed to approach the wearer's face more or less perpendicularly, then the bristles will require to be very soft and flexible. The choice between various possible materials for the bristles will be affected by considerations of the material producing no dermatitic, allergic or toxic reactions, and by the desirability of ensuring capillary action to assist removal of perspiration from that area of the wearer's face covered by the bristles.

It will usually be most convenient to form the backing strip or support member of seal 16 of a synthetic plastics material, nylon or polypropylene bring particularly favoured.

Figure 3:
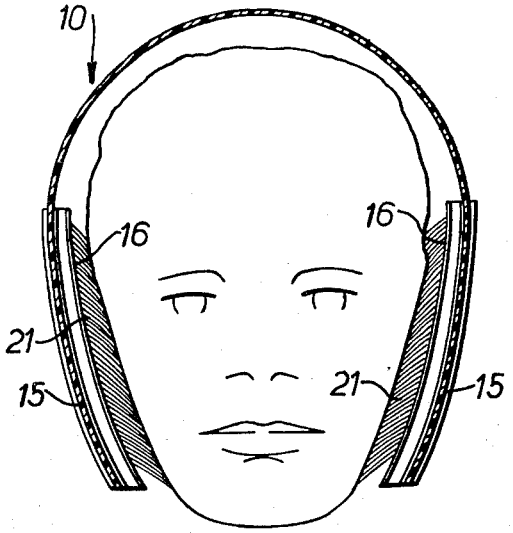
FIG. 3 shows a front view, partly cut away, of a respiratory helmet or the like incorporating the seal of the invention applied to a human head.

FIG. 3 shows a sectional front view of the helmet 10 applied to a human head. The helmet 10 has attached to it a visor 15. The bristles 21 can be seen spanning the gap which would otherwise exist between the edges of the visor and the sides of the face.

Figure 4:
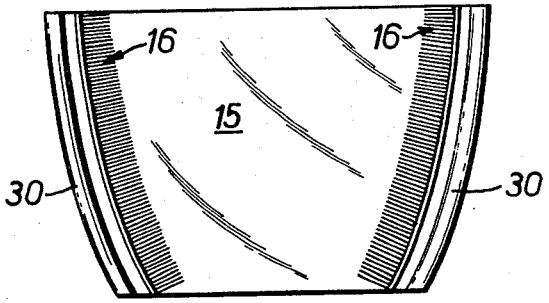
FIG. 4 shows a rear view of a visor member provided with seals according to the invention.
Figure 6:
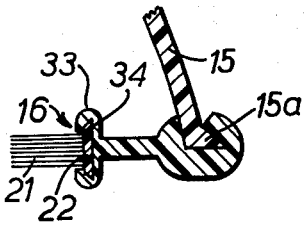
FIG. 6 shows to an enlarged scale a detail of FIG. 5.
Figure 5:
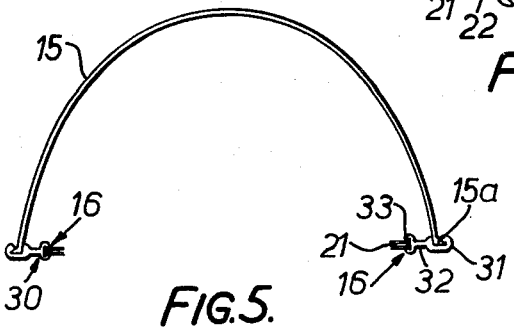
FIG. 5 shows a top view of the visor of FIG. 4.

FIGS. 4 and 5 show how adaptor members 30 may be used to fill in a part of the space between the margin of a visor and the wearer's face. The margin of the visor is shown as having at 15*a* an out-turned rim enabling the matingly slotted rim portion 31 of an adaptor member 30 to be slid or snapped into engagement with it. Adaptor member 30 has, extending inwardly of the visor from rim 31, a web portion 32, terminating at its inner edge in a means 33 for mounting thereon the sealing member 16 thereto. FIG. 6 shows this construction to an enlarged scale. It may be seen from FIG. 6 that the backing strip 22 of sealing member 16 is of dovetail form and engages in a matingly formed slot 34 in mounting means portion 33 of the adaptor member.

While preferred embodiments of the invention have been illustrated and described it will be understood that modifications may be made within the competence of those skilled in the art without departing from the scope of the invention as defined by the appended claims.

What is claimed is:

1. A respiratory helmet comprising means providing filtered air, visor means guiding air in front of the wearer's face, and air flow restricting means restricting the egress of air between said visor means and the sides of the wearer's face said air flow restricting means comprising a supporting member sealed to the lateral edge of the visor means and a multiplicity of bristles extending from said supporting member inwardly of the visor to engage the wearer's face.

2. A respiratory helmet, comprising (a) means for providing filtered air to the interior of said helmet;

(b) visor means for directing said filtered air to the front of a wearer's face;

(c) air flow restricting means arranged in contiguous relation between the lateral edges of said visor means and the sides of the wearer's face; and (d) channel shaped means for removably connecting said air flow restricting means in sealing relationship with the lateral edges of said visor means, whereby said air flow restricting means restrict the egress of filtered air between said visor means and the sides of the wearer's face.

3. A respiratory helmet as defined in claim 2, wherein said air flow restricting means comprises a supporting member connected with said connector means and a multiplicity of bristles extending from said supporting member inwardly of the visor to engage the wearer's face.

4. A respiratory helmet as defined in claim 3, wherein said bristles have a diameter within the range of 0.003 to 0.25 mm.

5. A respiratory helmet as defined in claim 3, wherein said bristles have lengths in the range of 10–30 mm.

6. A respiratory helmet as defined in claim 3, wherein said bristles are formed from a material selected from the group comprising horse hair, camel hair, nylon and polypropylene.

7. A respiratory helmet as defined in claim 3, wherein said bristles extend in inclined relation from said supporting member.

8. A respiratory helmet as defined in claim 3, wherein said bristles are arranged in a plurality of rows.

9. A respiratory helmet as defined in claim 3, and further comprising an adaptor member for connecting said air flow restricting supporting member in sealed spaced relation with said connector means.

* * * * *